United States Patent [19]

Moyle et al.

[11] 4,039,423

[45] Aug. 2, 1977

[54] PREPARATION OF PETROLEUM PITCH

[75] Inventors: Maurice Moyle, Oakville; Buenaventura B. Galvez, Islington; Eric C. Pease, Campbellville; Alan Logan, Oakville, all of Canada

[73] Assignee: Gulf Oil Canada Limited, Toronto, Canada

[21] Appl. No.: 556,856

[22] Filed: Mar. 10, 1975

[51] Int. Cl.[2] ..... C10G 3/00

[52] U.S. Cl. ..... 208/4; 208/5; 208/6

[58] Field of Search ..... 208/4, 5, 6

[56] References Cited

U.S. PATENT DOCUMENTS

| | | | |
|---|---|---|---|
| 3,238,116 | 3/1966 | Hamner et al. | 208/6 |
| 3,725,240 | 4/1973 | Baum | 208/4 |
| 3,923,633 | 12/1975 | Seuolt et al. | 208/6 |

*Primary Examiner*—Veronica O'Keefe

*Attorney, Agent, or Firm*—D. R. Morrison

[57] ABSTRACT

A process having a particular sequence of steps, each under specified conditions, for preparing a petroleum pitch binder suitable for electrodes used in smelting aluminum is disclosed. In the essential steps of the invention a decant oil petroleum fraction is heat treated under pressure, the treated material is flashed to a lower pressure, and finally the material is oxy-activated under elevated temperature conditions to form a petroleum pitch having the desired properties.

4 Claims, No Drawings

PREPARATION OF PETROLEUM PITCH

This invention relates to the preparation of a petroleum pitch, and more particularly to a process for the conversion of a heavy clarified bottoms fraction of a catalytic gas oil cracking operation to a petroleum pitch acceptable to the aluminum industry as an electrode binder.

Numerous processes have been described in the literature for the preparation of petroleum pitches which have been proposed as substitutes for coal tar pitch but, despite the increasing cost and shortage of coal tar pitch, much of the aluminum smelting industry has made little or no use of these previously proposed petroleum pitches as a binder for the electrodes used in aluminum smelting pots. Failure of petroleum pitch to achieve recognition as an acceptable binder appears to be particularly incongruous when the material to be bound by the binder in electrodes for aluminum smelting is another petroleum product, petroleum coke. Basic to the problem of substituting petroleum pitch for coal tar pitch as an electrode binder are the indefinite and variable natures of the chemical compositions or constitutions of both materials, and more particularly of the materials from which they are derived. As a consequence, the tests used to assess the suitability of materials as binders for electrodes are largely empirical and a final determination of the suitability of a material as a binder can only be made by trial in a full scale operating aluminum potline.

However, despite the empirical nature of much of the assessment of petroleum pitch as a binder for electrodes, certain essential or highly desirable properties of sucn binders are known and, to the extent that they can be determined and compared, it is necessary or advantageous to optimize them. Thus the softening point of a pitch can readily be measured and varied by appropriate variations in the steps used in preparation of the pitch. Softening point of a petroleum pitch thus can be optimized to satisfy the particular temperature requirements for pitch that is appropriately fluid at the temperature of mixing with the coke and any other material to be bound thereby, and is solid at the temperatures at which the electrodes formed therewith must subsequently be manipulated. Throughout this specification and ensuing claims, the softening point referred to is that determined by the ASTM D36 (Ring and Ball) Method. Another more empirical assessment made on binder pitch is the socalled "beta resin" content, or content of material insoluble in benzene but soluble in quinoline, as determined by successive extractions of pitch samples with these solvent materials. Beta resins are believed to be desirable ingredients in electrode binder pitches, hence it is desirable to optimize the proportion of these materials in pitches when preparing the latter as electrode binders. However, determination of the proportion generally is a time consuming operation involving prolonged solvent extractions, hence beta resin content generally is not a suitable parameter for purposes of process control, particularly for continuous processes. Likewise another empirical assessment is the coking value, which is an indication of the proportion of the pitch which will remain in the electrode as carbon after the electrode is baked. However coking value determinations, done in the conventional manner for all carbonaceous materials, are also time consuming and hence they are not suitable for process control.

In the prior art the processes used in efforts to prepare acceptable electrode binder pitch from the heavy clarified bottoms fraction of a catalytic gas oil cracking operation, commonly known as decant oil, have involved (1) heat treatment to induce cracking and other reactions which improved the properties of the products for use as electrode binder, and (2) oxidation by blowing heated decant oil with gas containing free oxygen, again to induce reactions which improved the properties of the products for use as electrode binder. A combination of the thermal treatment followed by the oxidation process has also been suggested but the conditions heretofore prescribed for this sequence do not appear to have provided a product acceptable to the aluminum smelting industry as an electrode binder.

It has now been found that, with a preferred sequence of thermal and other treatment steps under specified conditions hereinafter set out, the third of which steps involves an activation with free oxygen, most conveniently as air (oxyactivation), it is possible to prepare, from a full range decant oil having a boiling range at atmospheric pressure at least 95% of which is above 450° F (232° C), an electrode binder pitch which meets the requirements of the aluminum smelting industry. The invention thus consists in a process for the preparation of a petroleum pitch binder for the manufacture of carbon electrodes, comprising (1) subjecting a full range decant oil petroleum fraction, obtained as the clarified bottoms fraction of a catalytic gas oil cracking operation and having a boiling range at atmospheric pressure at least 95% of which is above 450° F (232° C), to a severe heat treatment by rapidly raising the temperature of the fraction to the range from 775° to 975° F (413° to 524° C) under a pressure in the range from 15 to 30 atmospheres and maintaining the temperature in said range for a period of from 3 to 300 minutes, (2) flashing the heat treated fraction at a lower pressure in the range from less than atmospheric to 4 atmospheres to separate volatilized material from a heat treated liquid fraction having a resultant softening point in the range from 150° to 250° F (65° to 121° C) and (3) subjecting the said liquid fraction to an oxy-activated condensation by maintaining it at a temperature in the range from 400° to 500° F (204° to 260° C) under a pressure in the ramge from atmospheric to 4 atmospheres, simultaneously with air being introduced into said fraction, preferably in a proportion of at least 50 liters of air per hour per kilogram of fraction, for a period of from one to 24 hours until said liquid fraction has a softening point in the range from 175° to 275° F (79° to 135° C).

It must be noted that the final step of the process of this invention, involving oxy-activated condensation, does more than merely raise the softening point of the product to a desired value. For example it is possible to heat treat a first sample of decant oil then vacuum flash distill the heat treated material to leave a residual first product having the same softening point as a second product made from a second sample of the same decant oil that is heat treated to the same extent as the first sample, then flashed at any convenient pressure to leave an intermediate residue having a much lower softening point which is then raised by oxyactivated condensation, as is done in the present invention, to form a second final product having the same softening point as the first product. However, although the two products have the same softening point, have numerous other properties that are widely disparate, and the first product is not suitable as an electrode binder pitch for aluminum smelting, lacking for example a suitable proportion of beta resin content.

Throughout this specification and ensuing claims, any percentages expressed are percentages by weight unless otherwise specifically indicated.

It was previously indicated herein that the compositions of decant oils vary over a wide range. As readily determined by gradient elution chromatography, i.e. by the adsorption of samples on a chromatographic column followed by elution of discrete fractions by selected solvents, components of decant oil include saturates (normal-, iso-, and cyclo-paraffins), aromatics (alkyl benzenes, benzocyclo-paraffins, and polynuclear aromatics, including alkyl- and cycloalkyl substituted ones), and polars (primarily heterocyclic nitrogen or oxygen containing aromatics); sulfur compounds in the compositions are mostly included with the aromatics in such determinations, which are based on modifications of the ASTM D2007 procedure. The desirable beta resins in electrode binder pitch are known to be highly aromatic in character, hence the aromatics content of decant oils can be expected to contribute greatly to the formation of beta resins in the preparation of electrode pitch from decant oil. However the saturates content of decant oils has not been expected to contribute significantly to the formation of useful components of highly aromatic electrode binder pitch. For this reason it has been the frequent practice, in trying to prepare acceptable electrode binder pitches from decant oils, to extract the bulk of the saturates from the oils and to prepare pitch from extracted decant oils which, by virtue of the removal of saturates therefrom, have a much higher proportion of aromatics in their composition.

It has also been stated in the art that, when treating a decant oil with oxygen at elevated temperatures to make an electrode binder pitch, it is essential that the decant oil be an extracted material having the bulk of the saturates removed by the extraction. Obviously the additional extraction step increases the cost of producing electrode binder pitch from decant oil and reduces the yield of pitch potentially obtainable from the decant oil by removal of material that could otherwise beneficially appear in the pitch. Thus it is completely unexpected that a full range (unextracted) decant oil can be converted into an acceptable electrode binder pitch by a method which includes treating such decant oil with oxygen at elevated temperature.

As previously indicated herein, the present invention requires a specific sequence of three essential steps viz: (1) heating a full range decant oil to a temperature in the range 775° to 975° F (413° to 524° C) under15 to 30 atmospheres pressure for a restricted period of from 3 to 300 minutes, (2) flashing the hot oil at a lower pressure in the range from atmospheric to four atmospheres to remove a resulting portion of vaporized material, and (3) subjecting the residual liquid fraction to an oxy-activated condensation by maintaining it at a temperature in the range from 400° to 500° F (204° to 260° C) under a pressure in the range from atmospheric to 4 atmospheres while simultaneously introducing air into the liquid fraction for a period of from one to 24 hours until it has a softening point in the range from 175° to 275° F (79° to 135° C).

The first step in the process of the invention must be carried out under pressure in order to ensure that the material being heated remains predominantly in the liquid phase. The temperature achieved must be above substantially 775° F (413° C), as substantially no significant reaction occurs below this value. In the upper part of the operative temperature range there may develop a tendency for some of the decant oil to crack to lower molecular weight products, and more energy is required to achieve this part of the operative range; it is preferred therefore to operate in the range from 850° to 950° F (454° to 510° C) most preferably in the range 875° to 925° F (468° to 496° C). The duration of time for which the oil is maintained in the range above 775° F (413° C) must be in the range 3 to 300 minutes, with the longer times in this range being required for the lower temperatures of the operative range. For example, substantially 300 minutes may be an appropriate time for reaction at operative temperatures below 800° F (427° C) and substantially 15 minutes may be appropriate time for reaction at substantially 900° F (482° C). If temperatures in the operative range are maintained longer than appropriate, the reaction proceeds so far that the softening point of the resulting intermediate product material becomes so high that there is no accomodation for the rise in softening point that will occur during the subsequent oxy-activated condensation step. As obtained from catalytic gas oil cracking operations, full range decant oil fractions have substantially no benzene insoluble content (generally less than 1%). During the first step of the process of this invention the proportion of benzene insoluble material increases as the reaction proceeds, and absence of an increase in this proportion indicates that reaction has not proceeded, and that the temperature has been too low or the time of reaction too short or both. Desirably the proportion increases to more than 5%, preferably to more than 10%, but, as indicated above, the reaction should not be made to proceed so far, under the influence of time and temperature, that the softening point of the intermediate product exceeds a value which does not provide sufficient allowance for the ensuing increase of the softening point which occurs during the subsequent oxy-activated condensation step. The first step can be carried out as either a batch or continuous flow operation. Continuous flow operation is preferred as, among other things, it is more efficient in time utilization, especially when short reaction times are involved; also it provides the easiest means to maintain agitation to ensure optimum extent of the desired reactions which occur at the elevated temperature. Furthermore, continuous flow operations are preferably carried out under conditions of turbulent flow rather than laminar flow, as the former minimizes coke formation and helps maintain in suspension any coke that is formed, thus reducing coke deposition on reactor walls; furthermore it ensures even more efficient mixing of the material and reduces the time and/or temperature conditions which would otherwise be required to achieve a desired degree of reaction.

Inasmuch as the second step of the process of the invention (flashing to reduce the pressure under which the material is maintained) inherently vaporizes the more volatile part of the material as well as discharging gases evolved during the first step of the process, the material will undergo a slight increase in softening point during the second step. As softening points are measured only at atmospheric pressure, it is the softening point of the material after the second step that is significant and should be taken into consideration when assessing the allowance to be made for the increase of softening point which will occur during the third step. And while softening point of the final product is not the only criterion of its quality, it is a convenient parameter which can readily be measured and used as a criterion of the state of other essential parameters. Generally, to satisfy the requirements of the aluminum industry, the petroleum electrode pitch, product of the final step of the process, must have a softening point in the range from 175° to 275° F (79° to 135° C). Desirably, at least substantially 25° F (14° C) of the increase in the softening point, which occurs during the process of the invention, is permitted to occur in the third step thereof. Preferably the residue from the second step has a softening point in the range from 150° to 200° F (66° to 93° C). In the third and final step in the process of the invention the intermediate product from the second step is subjected to an oxy-activation at temperatures in the range from 400° to 500° F (204° to 260° C), preferably under pressure up to 4 atmospheres, with air being injected into the liquid intermediate product, preferably in conjunction with mechanical agitation such as stirring, the agitation being an aid to better dispersion of air and consequent activation of the reactions which occur. Although the oxygen in the air used is known to be essential to the activation of the reactions which take place, analysis of the gases vented from the final step of the process shows that only a relatively small proportion of the oxygen in the air fed to the process is consumed, hence it is clear that the reactions taking place, although oxy-activated, are not all simple oxygen consuming reactions. They are believed to be primarily condensation reactions in which higher molecular weight compounds are formed by condensation of two or more lower molecular weight compounds under the activation of oxygen at the elevated temperature prevailing. The oxygen is believed to promote the condensation reactions by acting as a hydrogen scavenger, forming water as byproduct. When mechanical agitation is not used as an aid to dispersing air in the material being treated, higher proportions of air can be used to improve the dispersion by creating greater turbulence during passage through the material, for example, 500 liters per hour per kilogram of material being treated. When mechanical agitation is used, lower proportions of air may be used, for example less than 100 liters per hour per kilogram of material being treated. A convenient range to use with or without agitation is in the range from 250 to 350 liters/hr/kg. of material. Care must be taken however, to ensure that air is not dispersed into oil at a temperature so high that uncontrolled or runaway exothermic oxidation reaction develops. For this reason the temperature during the oxy-activation must be monitored and controlled within the specified range. The oxy-activation can be carried out as a batch or a continuous operation, care being taken in either case to ensure sufficient time for the oxy-activated reactions to occur in the chosen equipment at the desired temperature selected from the specified range. The continuance of the oxyactivated condensation for a period of from one to 24 hours, preferably between three and ten hours, causes an increase in the softening point of the intermediate product, and preferably the condensation is continued until the softening point of the material has risen at least 25° F (14° C), but not beyond the desired final value in the range from 175° to 275° F (79° to 135° C). The volatile products which separate during the last step of the process can be disposed of in any convenient manner, there being sufficient fuel value in them to warrant combustion as fuel for example. The residual material, on cooling to ambient room temperature, solidifies to a brittle petroleum pitch product.

The invention can now be more readily described by reference to the following examples which are given to illustrate the invention without limiting the scope thereof as defined in the ensuing claims.

EXAMPLE 1

To carry out the first step of the process of the invention for this example, a full range decant oil was fed continuously to a tubular reactor heated by immersion in a bed of sand fluidized with a steady stream of nitrogen and with the bed maintained at a desired elevated temperature by electric resistance heaters. A preheat section of the reactor served to raise the temperature of the decant oil rapidly to about 900° F (482° C). The decant oil used had an initial boiling point of substantially 410° F (210° C) and substantially 99% boiled in the range up to 1100° F (593° C); it contained less than 1% benzene insoluble material. The oil was fed to the reactor at a rate of 1090 gm. per hour which provided a residence time in the tube at a temperature above about 900° F (482° C) of 11.6 minutes. Averaged temperature in the tube for this period was 940° F (504° C). Pressure in the reactor was maintained at about psig (20 atmospheres). On passing continuously from the reactor through a pressure reducing valve the heat-treated material flowed into and was accumulated in a vacuum flash pot maintained at an absolute pressure of 150 mm. Hg. The accumulated material was drained periodically to storage at atmospheric pressure. This liquid intermediate product, obtained in a yield of 56.3% by weight of the feed, was found to have a Softening Point of 164° F (73° C), a Benzene Insoluble content of 12.7%, Quinoline Insolubles content of 0.9%, and a coking value of 40.5. An additional 31.2% of the feed was recovered as overhead oil condensed from the vapors evolved in the flash pot, and the remaining 12.5% of the feed was vented as uncondensed gases from the flash pot. Four batches of the liquid material were charged in turn to a stirred autoclave having a volume capacity of about 5 liters. It was equipped with feed and product removal lines, an impeller type stirrer, a sparger to distribute air into the bottom of the kettle contents, and a vent line with a condenser for liquid overhead products, a back pressure regulator to maintain air pressure in the kettle at a set value, and a wet test meter to measure the volume of vented gas. Air was sparged into each batch at a measured rate while the material was held at a temperature of 445° to 450° F (229° to 232° C) with the pressure maintained around 3 atmospheres absolute; the reaction conditions were maintained for 2.8 hours for the first batch and 4.0 hours for the other three batches. Following the period of air sparging at the indicated temperature which induced oxy-activated condensations in the batches, the material was drained from the autoclave and its softening point determined. In the following Table 1 are listed the weight (in kilograms) of the four batches (a) to (d), the flow rate of air to each batch (in liters/hour/kg. of batch), the weight (in grams) of condensed liquid recovered from the vented gases, and the Softening Point (in ° F and ° C) of the batch product.

TABLE 1

| Batch | Weight (kg) | Air Rate (l/hr/kg) | Overhead Conds. (gm) | S.P. (° F. & (° C)) |
|---|---|---|---|---|
| (a) | 3967 | 347 | 0 | 206 (97) |

TABLE 1-continued

| Batch | Weight (kg) | Air Rate (1/hr/kg) | Overhead Conds. (gm) | S.P. (° F. & (° C)) |
|---|---|---|---|---|
| (b) | 4254 | 295 | 27 | 199 (93) |
| (c) | 4072 | 293 | 13 | 203 (94) |
| (d) | 4351 | 268 | 22 | 200 (93) |

The four product batches were composited and additional measurements of properties of the composite material were made with the following results:

Softening Point —201° F (94° C)
Benzene Insoluble Material —21.3%
Quinoline Insoluble Material —0.6%
Coking Value —44.6

EXAMPLE 2

The first step of the process in this example was likewise carried out in a similar tubular reactor to that previously described in Example 1. The decant oil used for the feed to the reactor had an initial boiling point of substantially 406° F (208° C), a final boiling point of substantially 1067° F (575° C) and 95% of it boiled above 467° F (242° C). The oil was fed to the reactor at a rate of 1640 gms. per hour which provided a residence time for the feed in the tube at a temperature above about 900° F (482° C) of 13.5 minutes. Pressure in the reactor was maintained at about 300 psig (20 atmospheres) and averaged temperature in the tube was 930° F (499° C). On passing continuously from the reactor the heat-treated material flowed into, and was accumulated in, a vacuum flash pot which was maintained at an absolute pressure of 100 mm. Hg. and from which accumulated liquid was periodically drained to atmospheric pressure. The accumulated liquid intermediate product was obtained in a yield of 57.6% by weight of the feed, with 36.0% by weight of the feed being recovered as oil condensed from the vapors evolved in the flash pot and the remaining 6.4% of the feed being vented as uncondensed gases. The intermediate product was found to have a Softening Point of 173° F (78° C), a Benzene Insolubles content of 9.5%, Quinoline Insolubles content of 0.4%, and a Coking Value of 42.6. As in Example 1, four batches of the intermediate product were charged in turn to the same stirred autoclave and each batch was agitated and maintained at 450° F (232° C) for a specific period under pressure of 3 to 3.5 atmospheres absolute. Following the period of oxy-activated reactions, the material of each batch was drained from the autoclave and its softening point determined. The petroleum pitch products obtained from the batches then were composited and additional properties of the composite were determined. In the following Table 2 are listed, for the four batches (a) to (d) respectively, the rate of sparging air into the batch in liters/hour/kg. of batch, the duration of the sparging operation in hours, the weight in grams of the condensed liquid recovered from the vented gases, and the Softening Point in ° F and ° C of the batch pitch product.

TABLE 2

| Batch | Air Rate (1/hr/kg) | Time (hours) | Overhead Conds. (gm) | S.P. (° F. & (° C)) |
|---|---|---|---|---|
| (a) | 294.0 | 10.3 | 274 | 248 (120) |
| (b) | 334.3 | 8.3 | 3 | 245 (118) |
| (c) | 275.7 | 9.0 | 21 | 246 (119) |
| (d) | 285.7 | 10.0 | 6 | 250 (121) |

From a total feed of 16.22 kg. of feed in the four batches a composite petroleum pitch product weighing 15.86 kg. was obtained, a yield of 97.8%. The composite pitch had a Softening Point of 242° F (117° C), a Benzene Insoluble content of 26.8%, Quinoline Insolubles of 0.3%, and a Coking Value of 49.7.

Numerous properties of electrodes, prepared from each of the petroleum pitch products of the foregoing two examples, were determined for both Soderberg and pre-baked type electrodes. For properties such as Binder Content, Paste Elongation, Paste Thermal Stability, Green Apparent Density, Baked Apparent Density, Volume Change on Baking, Air Permeability, Electric Resistivity, Compressive Strength, Bending Strength, Pseudo-tensile Strength, Young's Modulus, Thermal Conductivity, Coefficient of Thermal Expansion, Air Oxidation Rate, Anode Consumption, and others, the values found were held by an aluminum smelter to be acceptable for use of the pitches in aluminum potline for the smelting of alumina.

Numerous modifications can be made in the specific expedients described without departing from the invention disclosed, the scope of which is defined in the following claims.

What is claimed is:

1. A process for the preparation of a petroleum pitch binder for the manufacture of carbon electrodes, consisting essentially of (1) subjecting a full range decant oil petroleum fraction, obtained as the clarified bottoms fraction of a catalytic gas oil cracking operation and having a boiling range at atmospheric pressure at least 95% of which is above 450° F (232° C), to a severe heat treatment in the absence of any free oxygen containing gas by rapidly raising the temperature of the fraction to the range from 775° to 975° F (413° to 524° C) under a pressure in the range from 15 to 30 atmospheres and maintaining the temperature in said range for a period of from 3 to 300 minutes until the proportion of benzene insoluble material in the fraction has risen to at least 5% by weight, (2) flashing the heat treated fraction at a lower pressure in the range from less than atmospheric to 4 atmospheres to separate volatilized material from a heat treated liquid fraction having a resultant softening point in the range from 150° to 250° F (66° to 121° C) and (3) subjecting the said liquid fraction to an oxy-activated condensation by maintaining it at a temperature in the range from 400° to 500° F (204° to 260° C) under a pressure in the range from atmospheric to 4 atmospheres, simultaneously with air being introduced into said fraction, for a period of from 3 to 10 hours with air flow between substantially 100 to 500 liters per hour per kilogram of material being treated until said liquid fraction has a softening point in the range from 175° to 275° F (79° to 135° C).

2. A process as claimed in claim 1, in which the decant oil is raised to and held at temperature in the range from 850° to 950° F (454° to 510° C) for a period less than substantially 15 minutes by passage of a continuous flow thereof through a heated tube reactor at substantially 20 atmospheres pressure, said period providing an increase to substantially 10% in the proportion of benzene insoluble material in the heated decant oil.

3. A process as claimed in claim 2 in which the heated decant oil subsequently is vacuum flash distilled to remove the more volatile material and leave a residue having a softening point in the range from 150° to 200° F (66° to 93° C).

4. A process as claimed in claim 3 in which the oxy-activated condensation is carried out under air pressure of substantially three atmospheres with mechanical agitation and for a period of from substantially 3 to 10 hours with air flows between substantially 250° and substantially 350 liters per hour per kilogram of material being treated.

* * * * *